United States Patent [19]

Suzaki et al.

[11] Patent Number: 4,768,894

[45] Date of Patent: Sep. 6, 1988

[54] THERMAL PRINTER HAVING A FLAT PLATEN SUPPORT MECHANISM

[75] Inventors: Masafumi Suzaki, Hitachi; Katsumasa Mikami, Naka; Rooichi Kobayashi, Hitachi; Fumio Takahagi, Hitachi; Yousuke Nagano, Hitachi; Tomoji Kitagishi, Hitachi; Shigetaka Furukawa, Takahagi, all of Japan

[73] Assignee: Hitachi, Ltd., Tokyo, Japan

[21] Appl. No.: 58,195

[22] Filed: Jun. 4, 1987

[30] Foreign Application Priority Data

Jun. 6, 1986 [JP] Japan ..... 61-130129

[51] Int. Cl.[4] ..... B41J 11/08

[52] U.S. Cl. ..... 400/656; 400/120; 346/76 PH

[58] Field of Search ..... 400/120, 120 PH, 656, 400/657, 661, 649, 654, 655, 55, 56, 58; 346/1.1, 76 R, 76 PH; 219/216, 216 PH

[56] References Cited

U.S. PATENT DOCUMENTS 4,654,673 3/1987 Yanata et al. ..... 400/120
4,676,683 6/1987 Uchikata et al. ..... 400/120

FOREIGN PATENT DOCUMENTS 0056877 4/1983 Japan .
0201879 11/1984 Japan ..... 400/656
0013579 1/1985 Japan ..... 400/656

*Primary Examiner*—E. A. Goldberg
*Assistant Examiner*—Huan H. Tran
*Attorney, Agent, or Firm*—Antonelli, Terry & Wands

[57] ABSTRACT

In a thermal printer having a flat platen, a flat platen support mechanism comprises a flat platen support plate, and a frame body. A projection having a curvature is provided between the flat platen support plate and the frame body. The projection having a curvature is to be swingable freely and to be movable with a slip movement. The projection is arranged on a center line of a flat platen width. When a thermal head is pressed with the flat platen, the flat platen swings smoothly. The thermal head is face contacted uniformly with the flat platen.

18 Claims, 8 Drawing Sheets

THERMAL PRINTER HAVING A FLAT PLATEN SUPPORT MECHANISM

BACKGROUND OF THE INVENTION

The present invention relates to a thermal printer having a flat platen support mechanism, more particularly to a non-impact type thermal printer such as a thermal printer having a flat platen support mechanism and a thermal transfer printer having a flat platen support mechanism etc.. The present invention relates to a thermal printer having an improved flat platen support mechanism suitable for a uniform face contact between a platen printing flat face of the flat platen and a printing face of a thermal head.

A conventional thermal printer or thermal transfer printer employs in general a cylindrical platen (a platen having a round cross-sectional shape or a round platen) therein. However, this round platen has a comparatively large outer diameter dimension and has to form a flat portion owing to the elastic deformation at a contact portion against a thermal head. Therefore, the conventional thermal printer having the round platen or the thermal transfer printer having the round platen has a fatal defect therein, namely it is necessary to give a comparative large head pressing force against the thermal head.

On the other hand, a thermal printer including a flat platen having a flat portion or a thermal transfer printer including a flat platen having a flat portion does not require the elastic deformation for the flat platen. It makes the head pressing force of the thermal head against the flat platen smaller than that of the round platen, and also the flat platen becomes smaller in size than that of the round platen. Therefore the miniaturization of the printing apparatus is made possible by employing the flat platen.

The conventional thermal printer having the flat platen or the thermal transfer printer having the flat platen can achieve a high head contact face pressure, even under same head pressing force, in comparison with the thermal printer having the round platen or the thermal transfer printer having the round platen. The thermal printer having the flat platen or the thermal transfer printer having the flat platen can thus achieve a high printing quality on even a low smoothness transfer printing paper.

However, with the use of the thermal printer having the flat platen or the thermal transfer printer having the flat platen, the greatest technical problem to be solved therein is a head contact problem for the platen printing flat face of the flat platen against the printing face of the thermal head.

The contact condition between the conventional round platen and the thermal head is shown in FIG. 14. When a thermal head 101 contacts with a round platen 102 made of a rubber, even the thermal head 101 may contact through a transfer printing paper 103 to the round platen 102 under the inclination condition with a very small angle $\theta_o$ as shown in FIG. 14. A flat portion $l_o$ of the round platen 102 can be formed anywhere at the circumference of the round platen 102 so as to correspond to such situation. When the round platen 102 is employed in the thermal printer or the thermal transfer printer, the uniform head contact can be obtained always thereon.

On the other hand, the contact condition between the conventional flat platen and the thermal head is shown in FIG. 15. When a thermal head 101 contacts a flat platen 104, which is made of a rubber, and supported by a flat platen support plate 105, the thermal head 101 may contact through a transfer printing paper 103 with the flat platen 104 under the inclination condition with a very small angle $\theta_o$ as shown in FIG. 15. Only a part of the platen printing flat face 104*a* of the flat platen 104 is contacted by the printing face of the thermal head 101. However, it is impossible for the printing face of the thermal head 101 to contact uniformly with the whole platen printing flat face 104*a* of the flat platen 104. This causes a fatal defect because of occurrence of a printing deficiency.

From the experimentation by the inventors of the present invention, when the rubber platen having a rubber hardness $H_s=70°$ (JIS A scale) is employed in the thermal printer having the flat platen or the transfer thermal printer having the flat platen, it is necessary to keep a very small angle $\theta_o$ below about $\pm 0.1°$ so as to contact wholly the thermal head 101 with the platen printing flat face 104*a* of the flat platen 104. However it is impossible to keep within the allowed value of the very small angle $\theta_o$ as a practical matter in respect to the measurement error for installing the thermal head 101 and the flat platen 104.

Further, the case in which the flat platen 104 having a very small rubber hardness such as below $H_s=20°$ is employed and elastically deforms so as to contact wholly with the platen printing flat face 104*a* of the flat platen 104 is shown in FIG. 16. In this case, the reaction force distribution generated in the flat platen 104 becomes non-uniform at the upper side and the lower side of the flat platen 104 as shown in FIG. 17, because the deformation amount of the flat platen 104 differs at the upper side and the lower side thereof.

Such a non-uniformness of the reaction force distribution causes uneven printing density. Further, in the thermal transfer printer using an ink ribbon, non-uniformness causes a raising (shift up) phenomenon and a lowering (shift down) phenomenon of the ink ribbon. Such an ink ribbon shift up phenomenon and an ink ribbon shift down phenomenon is defined as a slip phenomenon, which is an ink ribbon slip movement toward the upper direction of the lower direction accompanying the transverse travelling of the thermal head by the ink ribbon movement from the large flat platen reaction force side to the small flat platen reaction force side.

In order to solve the above stated problems, a mechanism for uniform face contacting of the platen printing flat face of the flat platen with the printing face of the thermal head is proposed in, for example, Japanese Patent Laid-Open Nos. 201879/1984 and 56877/1983 etc.

Japanese Patent Laid-Open No. 201879/1984 discloses a thermal transfer printer wherein a triangular groove, which is provided at the central portion of the rear side of a flat platen support plate along the longitudinal direction, engages with a triangular projection. The triangular projection is provided on a frame body under the condition maintaining backlash condition. The flat platen support plate can swing freely about the apex of the triangular projection.

Japanese Patent Laid-Open No. 56877/1983 discloses a thermal transfer printer wherein support portions are provided on both sides of a flat platen. The support portion is supported movably freely with a frame body. A contact portion is provided on the rear side of the flat platen so as to contact with frame body. The center of rotation for the flat platen according to the support portion is consistent with the center of rotation of the contact portion. With the above stated thermal transfer printer, however, it is unable to obtain a uniform face contact between the thermal head and the flat platen.

The inventors of the present invention have been studied the representative conventional prior art as shown in FIG. 18, which modified the structure for the flat platen support mechanism of the thermal transfer printer shown in Japanese Patent Laid-Open No. 201879/1984.

A thermal head 101 is supported on a head holder 106 as shown in FIG. 18. The head holder 106 is supported so as to swing freely about the center point, which is a center 107*a* of a carriage transverse shaft 107. A flat platen 104 is supported integrally with a flat platen support plate 108.

The flat platen support plate 108 provides a triangular groove 108*a* having an angle about 90° at the central portion of the rear side along the longitudinal direction. The flat platen support plate 108 is supported through a frame body 109. The frame body 109 provides a triangular projection 109*a* having an angle about 60° along the longitudinal direction. A vertex 108*b* of the triangular groove 108*a* engages with a vertex 109*b* of the triangular projection 109*a*. The whole flat platen support plate 108 can swing freely about the vertex 108*b* of the triangular groove 108*a*.

The thermal head 101 presses through a transfer printing paper 103 to the platen printing flat face 104*a* of the flat platen 104 with a relative angle $\theta_o$. The thermal head 101 is pressed by the head holder 106 with a head pressing force $W_o$.

A contact point of the thermal head 101 against the transfer printing paper 103 is at a point $P_o$ which corresponds to the corner portion of the flat platen 104. In order to face contact the platen printing flat face 104*a* of the flat platen 104 against a printing face 101*a* of the thermal head 101, it is necessary that the angle of the flat platen 104 be the same angle of the thermal head 101 for the swing movement of the flat platen 104.

The flat platen 104 is unable to swing without the relative slip movement between the transfer printing paper 103 and the thermal head 101. The friction resistance force against the slip movement exists between the transfer printing paper 103 and the thermal head 101. Therefore the friction resistance force becomes a large resistance force against the swing movement of the flat platen 104. The restriction points of the whole flat platen 104 appear at two places which are the vertex 108*b* of the triangular groove 108*a* and the point $P_o$. Therefore no swing movement of the flat platen 104 occurs therein. Namely, it is impossible to obtain the uniform face contact between the thermal head 101 and the flat platen 104 in this thermal transfer printer.

Further, the inventors of the present invention studied the conventional prior art as shown in FIG. 19, which modified the structure for the flat platen support mechanism of the thermal transfer printer shown in Japanese Patent Laid-Open No. 56887/1983.

A thermal head 101 is supported by a head holder 106 as shown in FIG. 19. The head holder 106 is supported so as to swing freely about the center point 107*a* of a carriage transverse shaft 107. A projection portion 110*a* having a curvature R is provided on the rear side of a flat platen 110 along the longitudinal direction of the flat platen 110. The projection portion 110*a* of the flat platen 110 contacts a frame body 111.

Two support pins 110*b* are provided on both end sides of the flat platen 110. A vertex 110*c* of the support pin 110*b* is consistent with the center of curvature of the projection portion 110*a*. The support pin 110*b* is supported so as to swing freely about a support pin receiving portion 111*a*, which is provided on the frame body 111. The flat platen 110 swing freely about the vertex 110*c* of the support pin 110*b*.

The printing face 101*a* of the thermal head 101 is pressed through the transfer printing paper 103 against the platen printing flat face 104*a* of the flat platen 110 with a relative angle $\theta_o$. The restriction points of the whole flat platen 110 appear at two places, which are the vertex 110*c* of the support pin 110*b* and the point $P_o$.

Therefore no swing movement of the flat platen 110 occurs therein. Namely, it is impossible to obtain the uniform face contact between the platen printing flat face 104*a* of the flat platen 110 and the printing face 101*a* of the thermal head 101 in this thermal transfer printer.

SUMMARY OF THE INVENTION

An object of the present invention is to provide a thermal printer or a thermal transfer printer wherein a flat platen can swing smoothly when a printing face of a thermal head is pressed with a platen printing flat face of the flat platen.

Another object of the present invention is to provide a thermal printer or a thermal transfer printer wherein a printing face of a thermal head can be face contacted uniformly with a platen printing flat face of a flat platen.

A further object of the present invention is to provide a thermal printer or a thermal transfer printer wherein a high printing quality can be obtained.

A still object of the present invention is to provide a thermal printer or a thermal transfer printer wherein a stable ink ribbon running performance can be obtained.

According to the present invention, a thermal printer or a thermal transfer printer is provided which includes a thermal head, a flat platen pressing the thermal head, and a transfer printing paper being inserted between the thermal head and the flat platen, so that the printing is performed.

A flat platen support mechanism comprises a flat platen support member for supporting the flat platen, a frame body for holding the flat platen support member, and a contact portion member provided between the rear side of the flat platen support member and the front side of the frame body. The contact portion member is to be swingable freely and further to be movable with a slip movement.

The contact portion member is formed with a projection member having a curvature provided on the rear side of the flat platen support member or a projection member having a curvature provided on the front side of the frame body. The projection member is arranged substantially on a center line of a flat platen width of the flat platen.

Support portion members being supported by the frame body are provided on both end sides of the flat platen support member. The support portion members have a clearance with receiving portions for receiving the support portion member which receiving portions are provided on the front surface of the frame body so as not to restrict a swing movement and a slip movement of the contact portion.

The support portion members are supported by the receiving portions of the frame body of gravity of the whole flat platen support member including the flat platen. The flat platen is set to be at a standstill in a slightly predetermined inclination manner, in which a support point of the flat platen support member is shifted slightly at the center of gravity of the whole flat platen support member including the flat platen.

A projection portion member having a curvature is provided on the rear side of the flat platen support member including the flat platen or on the front side of the frame body for supporting the flat platen support member. The flat platen support member is made to contact the frame body by the projection portion member.

Such a projection portion member, which is provided on the front side of the rear side of the flat platen support member or on the frame body, receives the head pressing force of the thermal head and directs the force against the thermal head so as to form a face contact pressure for the printing. Thereby a slip movement between the flat platen support member and the frame body is possible.

When the thermal head is pressed with the transfer printing paper at a relative angle against the printing face of the thermal head and the platen printing flat face of the flat platen, the slip movement is performed between the flat platen support member and the frame body. On the other hand, no slip movement whatsoever is caused between the transfer printing paper and the thermal head because of no influence of the friction force. Therefore, the whole flat platen performs the swing movement.

The flat platen support member provides support portion member for being supported by the frame body at both end sides thereof. Such a support portion member is made to form a backlash structure so as to not restrict entirely the swing movement of the whole flat platen support member. The swing movement takes place about at least one of the corners of both end sides of the flat platen. The swing movement of the whole flat platen occurs at at first contact point between the thermal head and the flat platen through the transfer printing paper, namely one of the corners of both end sides of the flat platen, as a center for rotation.

As the structure of the support portion members being supported by the frame body, which is provided on both end sides of the flat platen support member, is made to form a backlash structure so as not to restrict entirely the swing movement of the whole flat platen support member, thereby the restriction of the swing movement of the flat platen can eliminated therein. Accordingly, the swing movement or the rotational movement of the whole flat platen is possible about at least one of the corners of both end sides of the flat platen.

The whole flat platen including the flat platen support member is supported at both end sides by the frame body at a line substantially along the center of gravity. As the frame body supports both end sides of the whole flat platen including the flat platen support member at the line of the center along gravity, the resistance moment (force of inertia) against the swing movement to the empty weight (tare weight) of the whole flat platen can be made practically negligible. Accordingly, the whole flat platen can swing smoothly.

The projection portion member is provided substantially at the center line of the flat platen width of the flat platen. The projection portion member provided on the rear side of the flat platen support member or on the front side of the frame body is set at substantially the center line of the flat platen width of the flat platen. After the uniform face contact is obtained between the flat platen and the thermal head, it functions to give the uniform face contact pressure distribution with substantially the platen printing flat face of the flat platen.

The upper side and the lower side of the flat platen are formed to be the same sizes when the projection portion member is set at a center line of the flat platen width of the flat platen. The head pressing force for working the flat platen is made to be equal at the upper side and the lower side of the flat platen under the center of the projection portion member.

Accordingly, no rotation moment of the whole flat platen owing to the head pressing force occurs, and the uniform face contact pressure between the thermal head and the flat platen can be obtained without the generation of inclination strike.

According to the present invention, even though the platen printing flat face of the flat platen may have a relative angle difference against the printing face of the thermal head, the face contact between the platen printing flat face of the flat platen and the printing face of the thermal head can be obtained through the swing movement of the flat platen.

The high printing quality of the thermal printer or the thermal transfer printer can be obtained without the printing deficiency and without the uneven printing density.

The face contact pressure distribution between the thermal head and the flat platen becomes uniform, so that the raising (shift up) phenomenon or the lowering (shift down) phenomenon of the ink ribbon can be prevented. Thereby a good ink ribbon winding performance can be obtained.

A high hardness rubber having a low bending force can be employed as a rubber for the flat platen, so that the face contact pressure between the thermal head and the flat platen can be made larger. Accordingly, the printing using even rough transfer printing paper of even low smoothness transfer printing paper can be realized.

During the swing movement of the flat platen, no slip movement between the transfer printing paper and the flat platen occurs therein. Further, no dirty mark phenomenon with respect to the transfer printing paper appears, and therefore the high printing quality of the thermal printer or the thermal transfer printer can be obtained.

DETAILED DESCRIPTION

Figure 1:
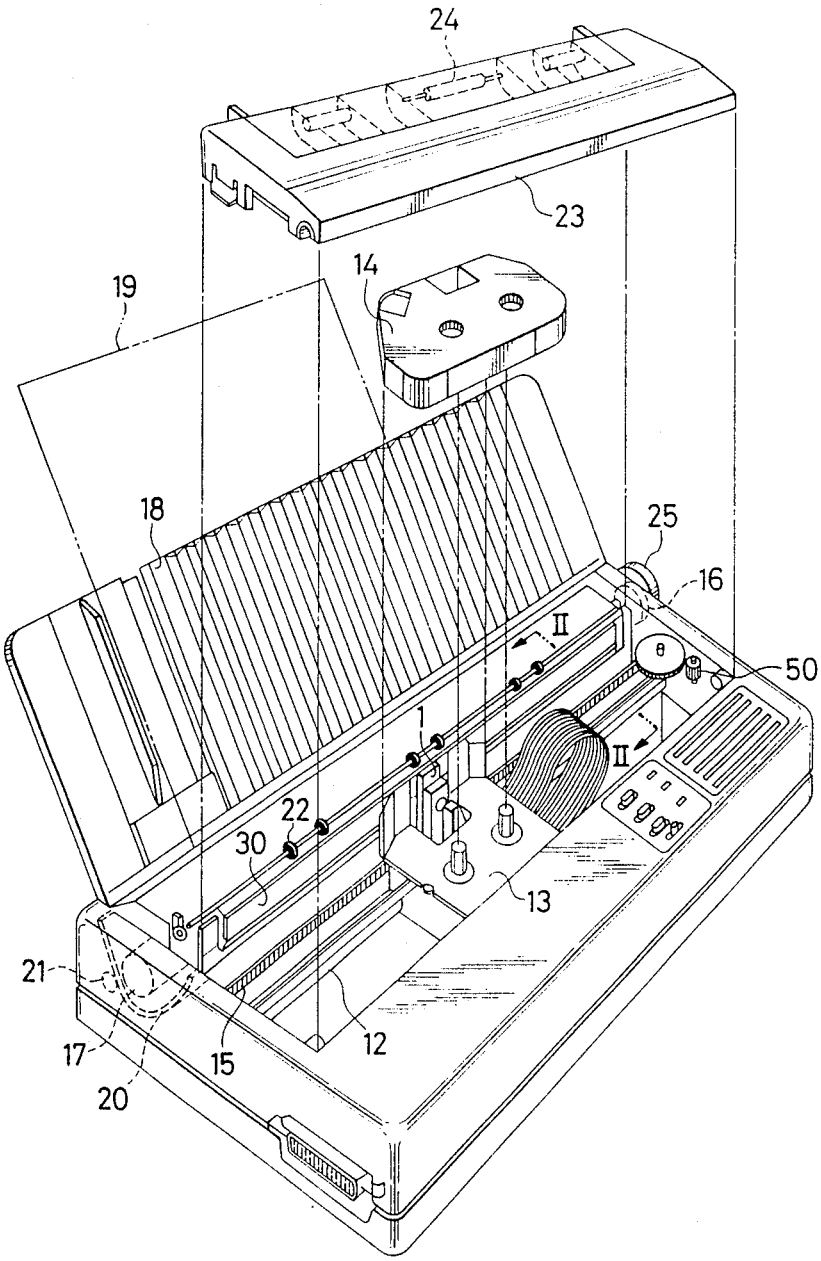
FIG. 1 is an exploded perspective overall view of a thermal transfer printer or a thermal printer in accordance with one embodiment of the present invention.

A thermal transfer printer or a thermal printer employing one embodiment of the present invention is shown in FIG. 1. A carriage 13 is disposed slideably on a carriage slide shaft 12. An ink ribbon cassette 14 and a thermal head 1 are mounted detachably on the carriage 13. The carriage 13 is arranged so as to be movable rightwards and leftward by a carriage motor 50 through a timing belt 15.

A driving power source is transmitted from a line feed motor 16 to a paper sending roller 17. A transfer printing paper 19 placed on a paper stand plate 18 travels between the paper sending roller 17 and a paper press roller 21 along a paper guide 20.

After the transfer printing paper 19 travels and is printed between a flat platen 30 and the thermal head 1, the transfer printing paper 19 travels further to a paper discharge roller 22 and a paper press roller 24 provided on the inner side of a cover 23 and is discharged therefrom. It is also possible to feed the transfer printing paper 19 in the same manner by turning a paper feed knob 25 by hand. The carriage motor 50, the line feed motor 16 and the thermal head 1 etc. are controlled respectively by a CPU (central processing unit).

Figure 2:
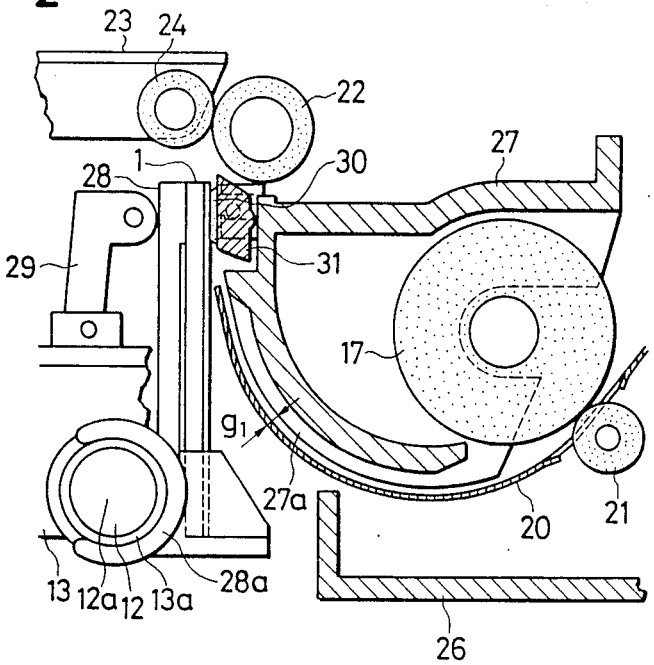
FIG. 2 is a partially cross-sectional view taken along a line II—II of FIG. 1.

The carriage slide shaft 12, a flat platen base 27, the paper guide 20 and the paper press roller 21 are mounted on a frame 26 as shown in FIG. 2. The carriage slide shaft 12 mounts slideably the carriage 13 thereon. A portion for installing a head socket 28 is mounted on the peripheral portion of a boss 13*a* of the carriage 13 which is adapted to swing about a center 12*a* of the carriage slide shaft 12.

The thermal head 1 is mounted on the head socket 28. A head lever 29 is mounted on the carriage 13. The head lever 29 is attracted by a solenoid being built in the carriage 13 and swings so as to transmit the head pressing force to the thermal head 1 through the head socket 28.

A flat platen support plate 31 provided with a rubber flat platen 30 is mounted on the flat platen base 27. The paper sending roller 17 made of a rubber and a paper discharge roller 22 made of a rubber are mounted rotatively on the flat platen base 27, respectively. A rib 27*a* is provided on the flat platen base 27 and acts as a paper guide under the paper feeding condition by forming a gap $g_1$ between the paper guide 20 and the rib 27*a* of the flat platen base 27.

Figure 3:
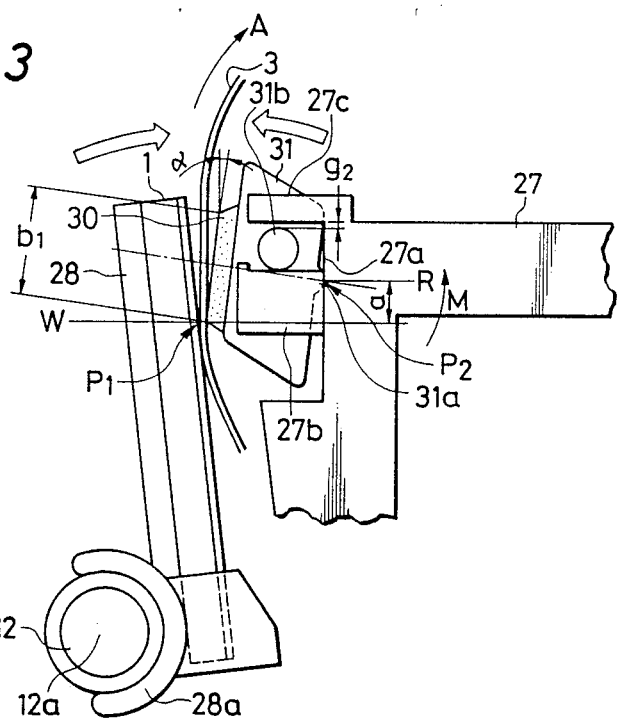
FIG. 3 is a side view showing structures of a flat platen and a flat platen support section so as to put into practice the principles of the present invention.

The structure for the flat platen support mechanism including the flat platen and the flat platen support section will be explained hereinafter with reference to FIG. 3. The flat platen 30 is constructed integrally with the flat platen support plate 31 by means such as a baking process, etc. The flat platen 30 is made of a rubber. The flat platen support plate 31 is made of an aluminium and formed by means such as a drawing process, etc.

A projection portion 31*a* having a curvature or a projection portion 31*a* having a substantially semi-circular sectional shape is provided continuously and integrally on the rear side of the flat platen support plate 31 along the longitudinal direction. The projection portion 31*a* is provided at about a center line of a flat platen width $b_1$ of the flat platen 30. Two support pins 31*b* are provided projecting and integrally at both end sides of the flat platen support plate 31.

The method for supporting the flat platen support plate 31 to the flat platen base 27 will be explained below. A flat face portion 27*a* is provided continuously and integrally on the flat platen base 27 along the longitudinal direction so as to contact the projection portion 31*a* of the flat platen support plate 31. Two support pin receiving portions 27*b* are provided on both end sides of the flat platen base 27.

The support pin 31*b* of the flat platen support plate 31 is mounted on the support pin receiving portion 27*b* of the flat platen base 27 and thereby the whole flat platen support plate 31 is supported through the flat platen base 27. A stopper 27*c* is provided on the flat platen base 27. The stopper 27*c* of the flat platen base 27 prevents the flat platen support plate 31 from being dragged toward the feeding direction of the transfer printing paper 3 when the transfer printing paper 3 contacts the flat platen 30 during the paper feeding condition.

A gap $g_2$ between the support pin 31*b* of the flat platen support plate 31 and the stopper 27*c* of the flat platen base 27 is set so as to not interface with in the support pin 31*b* and the stopper 27*c* of the flat platen base 27, even when the position of the support pin 31*b* of the flat platen support plate 31 varies in accordance with the swing movement of the flat platen support plate 31.

The position for setting the support pin 31*b* will be explained with reference to FIGS. 4 and 5. The lowest end point $P_3$ of the support pin 31*b* of the flat platen support plate 31 is set at a position which is to be shifted a very small amount $x_1$ to the side of the flat platen 30 with respect to the gravity position G of the whole flat platen support plate 31 including the flat platen 30.

Figure 5:
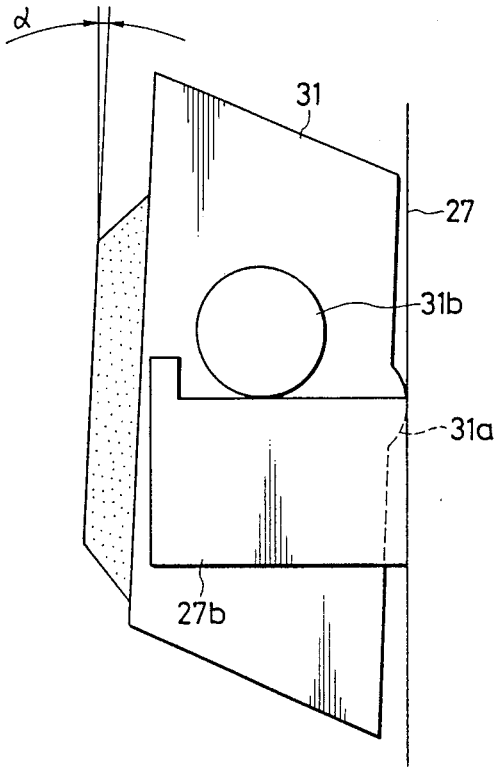
FIG. 5 is a schematic view showing an inclination angle of the flat platen when the flat platen contacts the thermal transfer printer.
Figure 6:
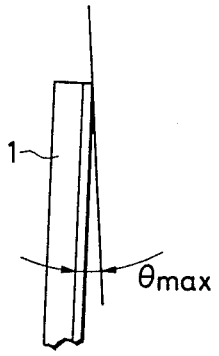
FIG. 6 is a schematic view showing a head touch angle error.

In accordance with the adaption of this structure for the flat platen support mechanism of this embodiment of the present invention, when the support pin 31*b* of the flat platen support plate 31 is mounted on the support pin receiving portion 27*b* of the flat platen base 27, the flat platen support plate 31 leans at a very small angle $\alpha$ with respect to the vertical line as shown in FIG. 5. A head touch angular tolerance $\theta_{max}$ as shown in FIG. 6 is a tolerance taking account of the dimension manufacture tolerance and construction tolerance of respective parts.

Figure 4:
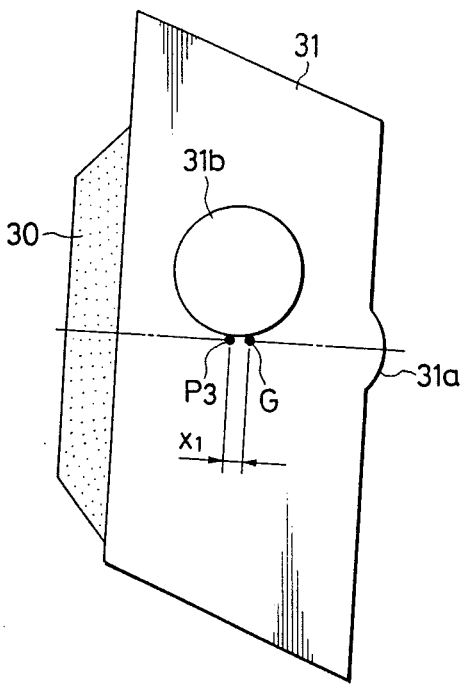
FIG. 4 is a side view showing a structure for a flat platen support mechanism including the flat platen, the flat platen support plate, and the flat platen base in the longitudinal direction and in the right-angled direction.
Figure 7:
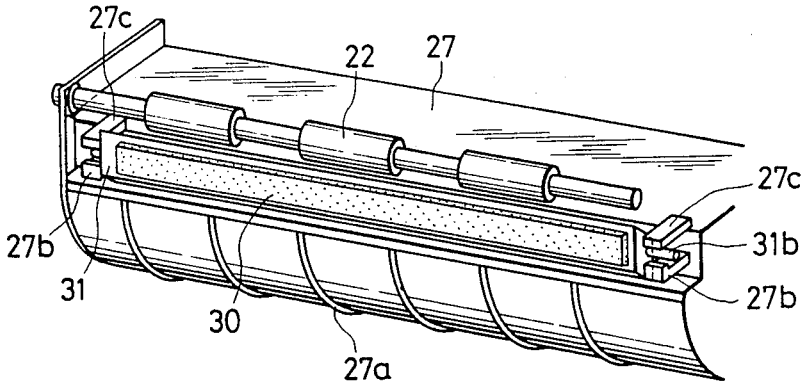
FIG. 7 is a perspective view showing the flat platen and the flat platen base.

The shift amount $x_1$ shown in FIG. 4 is set so that the very small angle $\alpha$ is a little larger than the head touch angular tolerance $\theta_{max}$. The flat platen support plate 31 is mounted on the flat platen base 27 as shown in FIG. 7.

Next, the operation of this structure having the flat platen support mechanism for the thermal transfer printer will be explained with reference FIGS. 3 and 8. The moment when the thermal head 1 contacts the flat platen 30 through the transfer printing paper 3, after the thermal head 1 have been swung, is shown in FIG. 3. The flat platen 30 leans toward the vertical line with the very small angle $\alpha$, so that the first contact point between the thermal head 1 and the transfer printing paper 3 is always at a contact point $P_1$ corresponding to the lower side corner portion of the flat platen 30.

The head pressing force W acts at the contact point $P_1$, and the reaction force R acts a contact point $P_2$ between the projection portion 31*a* and the flat platen base 27. The lines of action for the head pressing force W and the reaction force R are out of line by an amount a as shown in FIG. 3, so that the swing moment, $M=W.a$, acts against the flat platen support plate 31.

When the flat platen support plate 31 can perform the swing movement about the contact point $P_1$, the contact point $P_2$ slips, because the contact point $P_2$ does not restrict the slip phenomenon and further the support pin 31*b* of the flat platen support plate 31 does not restrict entirely the slip movement at the contact point $P_2$. Therefore, the flat platen support plate 31 can perform the swing movement about the contact point $P_1$.

Figure 8:
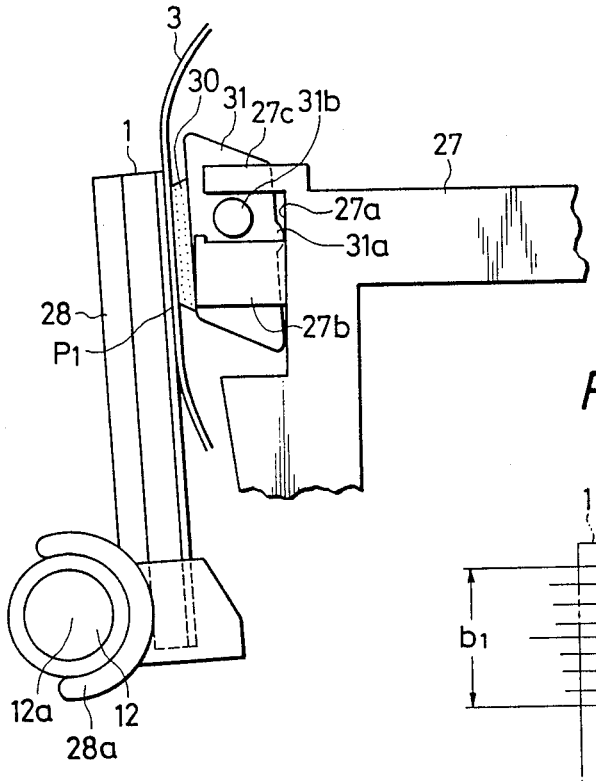
FIG. 8 is a side view showing the condition of the structures of the flat platen and the flat platen support section after the flat platen is swung.
Figure 9:
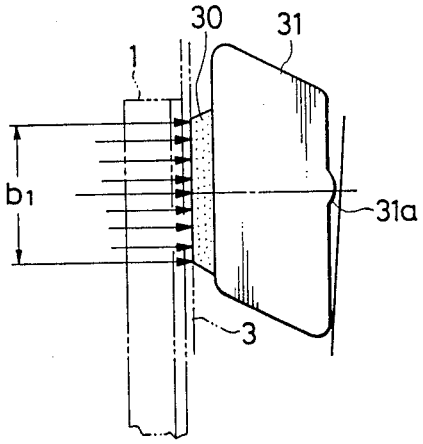
FIG. 9 is a schematic view showing a head pressing force distribution.

The uniform face contact is performed perfectly between the platen printing flat face of the flat platen 30 and the printing face of the thermal head 1 as shown in FIG. 8. When such a uniform face contact between the flat printing flat face of the platen platen 30 and the printing face of the thermal head 1 is obtained, the head pressing force W acts to against the flat platen width $b_1$ of the flat platen 30 with a uniform head pressing force distribution as shown in FIG. 9.

Further, the projection portion 31*a* of the flat platen 30 positions at the center of the flat platen width $b_1$ of the flat platen 30, so that no rotational moment acts thereon and the uniform face contact between the platen printing flat face of the flat platen 30 and the printing face of the thermal head 1 is maintained thereon. The resistance force against the slip movement at the contact point $P_2$ is made smaller than that of the slip movement at the contact point $P_1$.

In this embodiment having the flat platen support mechanism of the present invention, at the contact point $P_1$, the transfer printing paper 3 and the thermal head 1 contacts the corner portion of the flat platen 30, so that the resistance force against the slip movement is made large by the edge effect. Further, at the contact point $P_1$, when the surface roughness of the transfer printing paper 3 is large, the slip resistance force becomes large.

At the contact point $P_2$, the edge effect is eliminated by the provision of the curvature portion of the projection portion 31*a*, and the resistance force against the slip movement is made small. At the same time, the flat platen base 27 is formed of a plastic material, the surface roughness of the contact portion 27*a* of the flat platen base 27 is made small, so that the slip resistance force is lessened.

For the sake of diminishment of the slip resistance force, other embodiments having the flat platen support mechanisms of the present invention will be explained. By the employing of the structures having the flat platen support mechanisms of those embodiments of the present invention, a further good swingable performance for the flat platen can be obtained.

Figure 10:
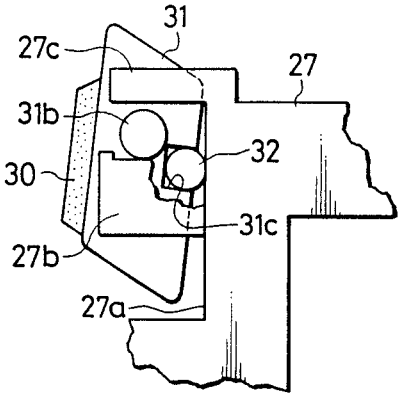
FIG. 10 is a side view showing a structure for a flat platen support mechanism including the flat platen, the flat platen support plate and the flat platen base in the longitudinal direction and in the right-angled direction in accordance with another embodiment of the present invention.

In FIG. 10, in place of the provision of the flat platen support plate having the integral projection portion stated in the above first embodiment of the present invention, a rectangular groove 31*c* is provided on the rear side of the flat platen support plate 31 in the longitudinal direction. A cylindrical roller 32 is inserted rotatively in the rectangular groove 31*c*. The cylindrical roller 32 contacts a contact flat portion 27*a* of the flat platen base 27. The cylindrical roller 32 may be provided continuously or may be provided at intervals in the longitudinal direction. A plurality of balls may provided in place of the cylindrical roller.

Figure 11:
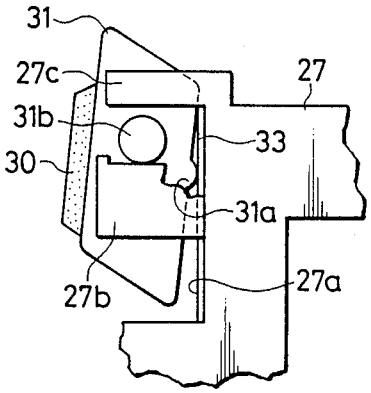
FIG. 11 is a side view showing a structure for a flat platen support mechanism including the flat platen, the flat platen support plate and the flat platen base in the longitudinal direction and in the right-angled direction in accordance with still another embodiment of the present invention.

In FIG. 11, a slip sheet member 33 is inserted between the projection portion 31*a* of the flat platen support plate 31 and the contact flat portion 27*a* of the flat platen base 27. The slip sheet member 33 has a very small coefficient of friction such as Teflon (trade mark) sheet etc. The embodiment shown in FIG. 10 may be combined with the embodiment shown in FIG. 11.

Figure 12:
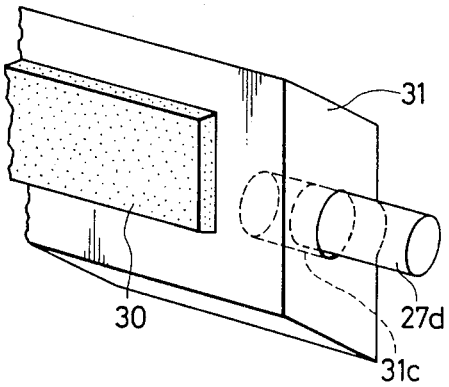
FIG. 12 is a side view showing structures of the flat platen and the support pin portion in accordance with another embodiment of the present invention.

Another structure for the flat platen support mechanism will be explained with reference to FIG. 12. In FIG. 12, two hole portions 31 are provided on both end sides of the flat platen support plate 31. A support pin portion 27*d* is provided on the flat platen base 27. The support pin 27*d* of the flat platen base 27 is provided on the hole portion 31*c* of the flat platen support plate 31 with a clearance.

Figure 13:
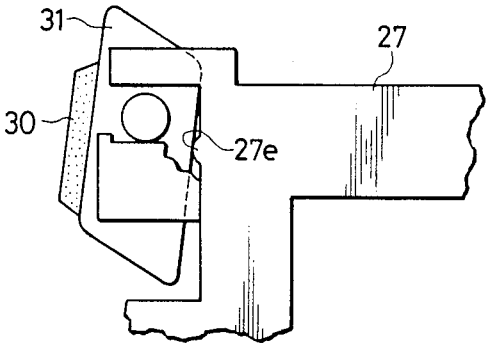
FIG. 13 is a side view showing a structure for a flat platen support mechanism including the flat platen, the flat platen support plate and the flat platen base in the longitudinal direction and in the right-angled direction in accordance with yet another embodiment of the present invention.
Figure 14:
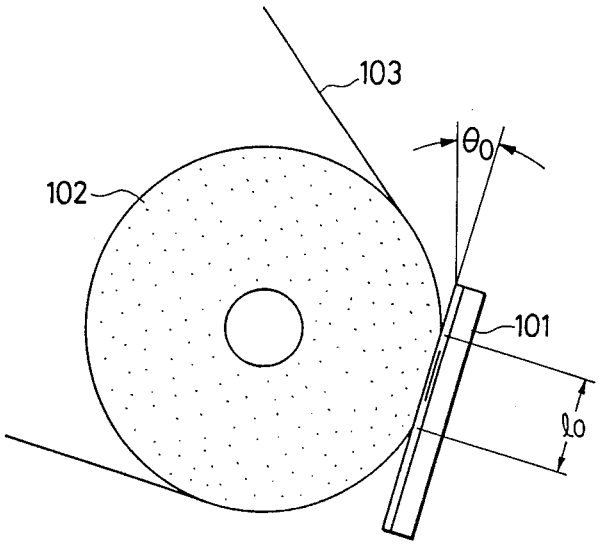
FIG. 14 PRIOR ART
FIG. 14 is a side view showing the contact condition between a round platen and a thermal head in the longitudinal direction and in the right-angled direction of prior art.
Figure 15:
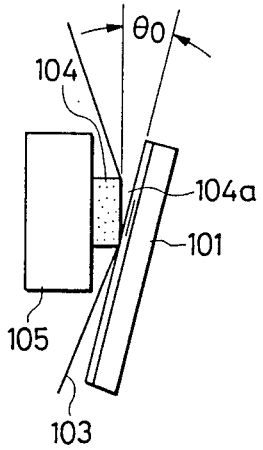
FIG. 15 PRIOR ART
FIG. 15 is a side view showing the contact condition between a flat platen and a thermal head in the longitudinal direction and in the right-angled direction of prior art.
Figure 16:
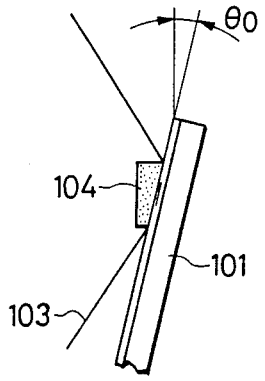
FIG. 16 PRIOR ART
FIG. 16 is a side view in which the flat platen has a small hardness rubber of prior art.
Figure 17:
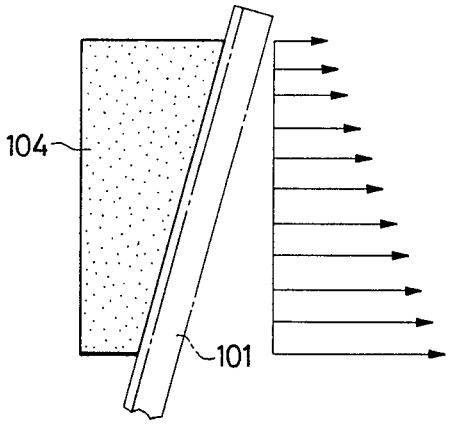
FIG. 17 PRIOR ART
FIG. 17 is a schematic view showing the flat platen reaction force distribution shown in FIG. 16.
Figure 18:
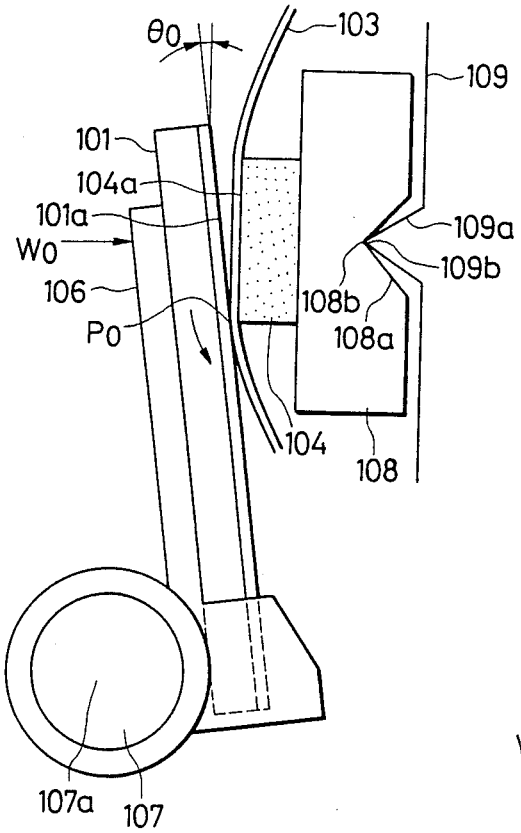
FIG. 18 PRIOR ART
FIG. 18 is a side view showing structures of the flat platen and the flat platen support section in the longitudinal direction and in the right-angled direction of prior art.
Figure 19:
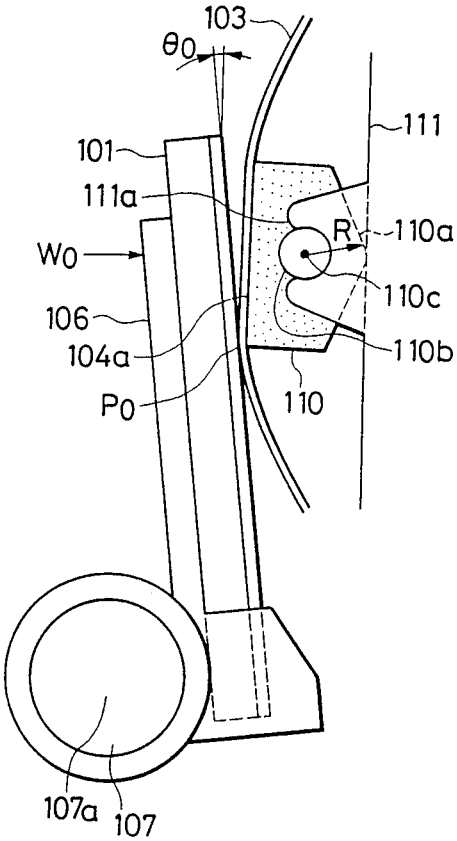
FIG. 19 PRIOR ART
FIG. 19 is a side view showing another structures of the flat platen and the flat platen support section in the longitudinal direction and in the right-angled direction of prior art.

Another embodiment having the flat platen support mechanism of the present invention will be explained with FIG. 13. In FIG. 13, in place of the projection portion on the flat platen support plate, a projection portion 27*e* having a curvature is provided on the flat platen base 27.

When the outer face of the flat platen 30 is coated with a material having a very small coefficient of friction such as Teflon sheet etc., the slip movement between the transfer printing paper 3 and the thermal head 1 at the contact point $P_1$ can be improved.

In the above described embodiments of the present invention the printing apparatus has no ink ribbon is stated. However even a printing apparatus having ink ribbon can utilize the same functions and effects.

We claim:

1. A flat platen supporting mechanism for use with a thermal printer having a thermal head, a flat platen pressing said thermal head, and a transfer printing paper being inserted between said thermal head and said flat platen, so that printing is performed comprising, a flat platen supporting member for supporting said flat platen, a flat platen mounting base for mounting said flat platen supporting member, and a contact portion member provided between a rear side of said flat platen supporting member and a front side of said flat platen mounting base, wherein said contact portion member comprises a projection provided on one of the rear side of said flat platen supporting member and the front side of said flat platen mounting base, and said contact portion member is swingable freely and movable with a slip movement between said flat platen supporting member and said flat platen mounting base.

2. A flat platen supporting mechanism according to claim 1, wherein said projection has a curvature provided on the rear side of said flat platen supporting member.

3. A flat platen supporting mechanism according to claim 1, wherein said projection has a curvature provided on the front side of said flat platen mounting base.

4. A flat platen supporting mechanism according to claim 2 or claim 3, wherein said projection is arranged substantially on a center line of a flat platen width of said flat platen supported by said flat platen supporting member.

5. A flat platen supporting mechanism according to claim 1, wherein supporting portion members being received by said flat platen mounting base are provided on both end sides of said flat platen supporting member.

6. A flat platen supporting mechanism according to claim 5, wherein said supporting portion member of said flat platen supporting member has a clearance between said supporting portion members and said flat platen mounting base so as to not restrict a swing movement and a slip movement of said contact portion member.

7. A flat platen supporting mechanism according to claim 6, wherein said flat platen supporting member is received by said flat platen mounting base substantially at a line of a center of gravity of the flat platen supporting member including said flat platen.

8. A flat platen supporting mechanism according to claim 7, wherein said flat platen is set at a standstill in a predetermined slightly inclined manner, in which a support point of said flat platen supporting member is shifted slightly at the center of gravity of said flat platen supporting member including said flat platen.

9. A flat platen supporting mechanism according to claim 1, wherein a groove is provided on the rear side of said flat platen supporting member, and a roller or a plurality of balls is inserted rotatively in said groove.

10. A flat platen supporting mechanism according to claim 1, wherein a slip sheet member having a very small coefficient of friction is provided on one of the rear side of said flat platen supporting member and the front side of said flat platen mounting base so as to reduce the slip resistance force between said flat platen supporting member and said flat platen mounting base.

11. A flat platen mechanism according to claim 1, wherein hole portions are provided on both end sides of said flat platen supporting member, support pin members are inserted in said hole portions of said flat platen supporting member with a clearance so as to allow said contact portion member to swing freely and further to permit a slip movement between said flat platen supporting member and said flat platen mounting base.

12. A flat platen supporting mechanism according to claim 1, wherein said flat platen supporting member has a plate-shaped form, and said flat platen is supported by said flat platen supporting member at a front portion of said flat platen supporting member.

13. A flat platen supporting mechanism according to claim 2, wherein said projection is provided integrally and horizontally along the rear side of said flat platen supporting member.

14. A flat platen supporting mechanism according to claim 3, wherein said projection is provided integrally and horizontally along the front side of said flat platen mounting base.

15. A flat platen supporting mechanism for use with a thermal printer having a thermal head, a flat platen pressing said thermal head, and a transfer printing paper being inserted between aid thermal head and said flat platen, so that printing is performed, comprising a flat platen supporting member for supporting said flat platen, a flat platen mounting base for mounting said flat platen supporting member, and a contact portion member provided between a rear side of said flat platen supporting member and a front side of said flat platen mounting base, said contact portion member includes a projection having a curvature and is provided on the rear side of said flat platen supporting member, said contact portion member is freely swingable and movable with a slip movement between said flat platen supporting member and said flat platen mounting base, and said projection is arranged substantially and horizontally along a center line of a flat platen width of said flat platen supported by said flat platen supporting member.

16. A flat supporting mechanism according to claim 15, wherein supporting portion members received by said flat platen mounting base are provided on both end sides of said flat platen supporting member.

17. A flat platen supporting mechanism according to claim 16, wherein said supporting portion member of said flat platen supporting member has a clearance between said supporting portion members and said flat platen mounting base to as to not restrict the freely swingable movement and the slip movement of said contact portion member.

18. A first platen supporting mechanism according to claim 16, wherein said flat platen supporting member is received by said flat platen mounting base substantially at a line through a center of gravity of the flat platen supporting member including said flat platen.

* * * * *